US007806398B2

(12) United States Patent
Joyce et al.

(10) Patent No.: US 7,806,398 B2
(45) Date of Patent: Oct. 5, 2010

(54) INGESTION GUIDE ASSEMBLY FOR AUGMENTING SHEET MATERIAL SEPARATION IN A SINGULATING APPARATUS

(75) Inventors: Steven H. Joyce, Wallingford, CT (US); James A. Fairweather, Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 414 days.

(21) Appl. No.: 11/866,631

(22) Filed: Oct. 3, 2007

(65) Prior Publication Data

US 2009/0091073 A1 Apr. 9, 2009

(51) Int. Cl.
*B65H 3/04* (2006.01)

(52) U.S. Cl. ..... 271/35; 271/10.06; 271/16

(58) Field of Classification Search ..... 271/10.1, 271/16, 19, 35, 110, 111, 121, 10.06
See application file for complete search history.

(56) References Cited

U.S. PATENT DOCUMENTS 2,922,643 A * 1/1960 Lopez ..... 271/35
3,126,201 A * 3/1964 Rehm ..... 271/104
4,909,499 A * 3/1990 O'Brien et al. ..... 271/10.06
4,953,842 A * 9/1990 Tolmie et al. ..... 271/2
4,978,114 A * 12/1990 Holbrook ..... 271/35
5,062,600 A * 11/1991 Holbrook et al. ..... 271/35
5,074,540 A * 12/1991 Belec et al. ..... 271/34
5,238,236 A * 8/1993 Belec et al. ..... 271/34
5,246,223 A * 9/1993 Ricciardi et al. ..... 271/149
5,288,064 A * 2/1994 Manabe et al. ..... 271/3.08
RE34,894 E * 4/1995 Golicz ..... 271/6
5,431,385 A * 7/1995 Holbrook ..... 271/122
5,601,282 A * 2/1997 Milo et al. ..... 271/35

(Continued)

FOREIGN PATENT DOCUMENTS

JP 60183446 A * 9/1985

*Primary Examiner*—Saúl J Rodríguez
*Assistant Examiner*—Howard Sanders
(74) *Attorney, Agent, or Firm*—Brian A. Collins; Angelo N. Chaclas

(57) ABSTRACT

An ingestion assembly is provided for a singulating apparatus having a conveyor system for moving a stack of sheet material along a feed path. The ingestion assembly is spatially positioned above the conveyor belt and includes at least one singulating roller driven in a direction opposing the motion of the conveyor belt. The ingestion assembly comprises an assembly support rotationally mounting the singulating roller at a downstream end portion and pivotally mounting to the singulating apparatus at an upstream end portion. A movable guide mounts to the assembly support and is positionable relative thereto as a function of a force vector imposed on the guide by the sheet material. Additionally, the moveable guide includes a surface operative to guide the sheet material into a singulating interface which is formed between the singulating roller and the conveyor system. In operation, sheet material enters the throat of the ingestion assembly and contact is made with the moveable guide. When the force vector, imposed by the sheet material, is less than a threshold level, the guide assumes a first position operative to shingle sheet material in preparation for singulation by the singulating roller. When the force vector, is greater than the threshold level, movable guide assumes a second position operative to pivot the assembly support and increase the singulating interface. Consequently, sheet material having a larger thickness dimension may pass for separation by the singulation apparatus.

17 Claims, 5 Drawing Sheets

U.S. PATENT DOCUMENTS 6,003,857 A * 12/1999 Salomon et al. ..... 271/122
6,135,441 A * 10/2000 Belec et al. ..... 271/35
6,276,679 B1 * 8/2001 Joyce et al. ..... 271/122
6,318,717 B1 * 11/2001 Daboub et al. ..... 271/124
6,644,659 B2 * 11/2003 Skadow et al. ..... 271/265.02
6,866,258 B1 * 3/2005 Golicz ..... 271/35
6,874,779 B2 * 4/2005 Park ..... 271/121
6,971,645 B2 * 12/2005 Coret et al. ..... 271/138
7,192,025 B1 * 3/2007 Golicz et al. ..... 271/34
7,467,790 B2 * 12/2008 Westhoff ..... 271/3.14
2003/0141650 A1 * 7/2003 Coret et al. ..... 271/34
2004/0056410 A1 * 3/2004 Skadow et al. ..... 271/10.01
2006/0113721 A1 * 6/2006 Kim ..... 271/121
2008/0099977 A1 * 5/2008 Salomon et al. ..... 271/35
2008/0230979 A1 * 9/2008 Asada et al. ..... 271/121

* cited by examiner

INGESTION GUIDE ASSEMBLY FOR AUGMENTING SHEET MATERIAL SEPARATION IN A SINGULATING APPARATUS

TECHNICAL FIELD

This invention relates to singulating sheet material/media, and more particularly, to a new and useful ingestion assembly for separating/singulating sheet material such as mailpieces and/or sheets of paper in a sheet singulating apparatus.

BACKGROUND ART

Material handling apparatus such as mailing machines commonly employ rollers and/or belts for transporting and separating sheet material. In the context used herein, "sheet material" is used generically to describe any substantially flat, two-dimensional media such as mailpieces, sheets of paper, postcards, laminate, woven material/fabric etc. Oftentimes, a combination of belts and rollers are employed, i.e., one set of rollers opposing a set of belts, to separate individual sheets from a stack of sheet material.

A common singulating apparatus, used in a variety of mailing machines/meters, employs a set of horizontal conveyor belts (typically three) moving in one direction along a transport deck and a pair of rollers disposed above and rotating in a direction opposing the conveyor belts. The belts typically transport a stack of mailpieces toward a V-shaped ingestion area or throat disposed between the rollers and the belts. The V-shaped ingestion area converges such that the rollers and belts define a singulation interface which is initially spring-biased to a closed position, but may open in response to loads imposed by mailpieces entering the ingestion area.

More specifically as mailpieces approach the V-shaped ingestion area, the opposing motion of the upper rollers causes the mailpieces to shingle such that the lowermost mailpiece of the stack enters the singulation interface. Preferably, the ingestion angle, i.e., the apex angle of the V, should be shallow to ensure that mailpieces are separated in the throat before reaching the interface. As the conveyor belts move mailpieces against the upper rollers, the interface opens due to the normal forces acting on the rollers. Furthermore, the friction force developed between the mailpiece and the conveyor belt is designed to exceed the retarding force developed between the mailpiece and the upper rollers such that the mailpiece passes through the interface and is "singulated" from the stack.

A variety of factors associated with the geometry and arrangement of the opposing rollers/belts can be difficult to control and/or to optimize the effectiveness/of the singulating apparatus. Of the various difficulties which can arise, a principal concern relates to leading edge damage as a mailpiece enters the singulating interface. More specifically, as the leading edge of a mailpiece contacts the singulating upper rollers, the leading edge can peel upwardly and fold back upon itself as a consequence of the opposing motion of the rollers. In addition to the leading edge damage, the build-up of thickness can jam and stall the operation of the singulating apparatus.

Moreover, the geometry of, and friction forces developed in connection with, the ingestion assembly, i.e., the combination of the singulating guide and rollers, can impact mailpiece shingling/separation and the effectiveness of the singulating roller(s). More specifically, difficulties are often encountered when processing/singulating: (i) mailpieces spanning a wide range of thicknesses, (ii) a combination of thick and thin mailpieces and/or (iii) mailpieces having a variety of surface finishes i.e., glossy, satin or flat surface finishes. Regarding the former, the geometry of the ingestion area, i.e., principally the ingestion angle, can cause a collection of thin mailpieces, or a single thick mailpiece, to change the effectiveness of the singulating roller. More specifically, a build-up of mailpieces upstream of the singulating roller can lift the ingestion assembly so as to cause multiple mailpieces to pass under the roller without being singulated. Additionally, the thickness of mailpieces contacting the singulating roller can ameliorate or exacerbate the effectiveness of the roller.

Regarding the latter, the surface finish determines the friction coefficient and, consequently, friction forces developed between various elements of the singulating apparatus. More specifically, the surface finish impacts the friction forces developed between (i) individual mailpieces, (ii) mailpieces and the upper ingestion assembly and, (iii) the lowermost mailpiece of the stack and the lower conveyor belts. Generally, the friction forces developed in one of these areas, must be higher or lower than the forces developed in another area. For example, the friction forces developed between the lower conveyor belt and the lowermost mailpiece must be higher than the forces in any other area for successful mailpiece singulation. Additionally, the friction forces developed between the upper ingestion assembly and the contacting mailpieces must be higher than the friction forces generated between individual mailpieces for successful mailpiece shingling. It will be appreciated, therefore, that the surface finish of mailpieces further complicates the shingling/singulation of mailpieces in a singulation apparatus.

A need, therefore, exists for an ingestion assembly for a singulating apparatus which accommodates both thin and thick mailpieces, is reliable, low-cost and mitigates damage to the leading edge portion of sheet material without impacting the efficacy and/or efficiency of a singulation apparatus.

BRIEF DESCRIPTION OF THE DRAWINGS

The accompanying drawings illustrate presently preferred embodiments of the invention and, together with the general description given above and the detailed description given below serve to explain the principles of the invention. As shown throughout the drawings, like reference numerals designate like or corresponding parts.

SUMMARY OF THE INVENTION

Figure 1:
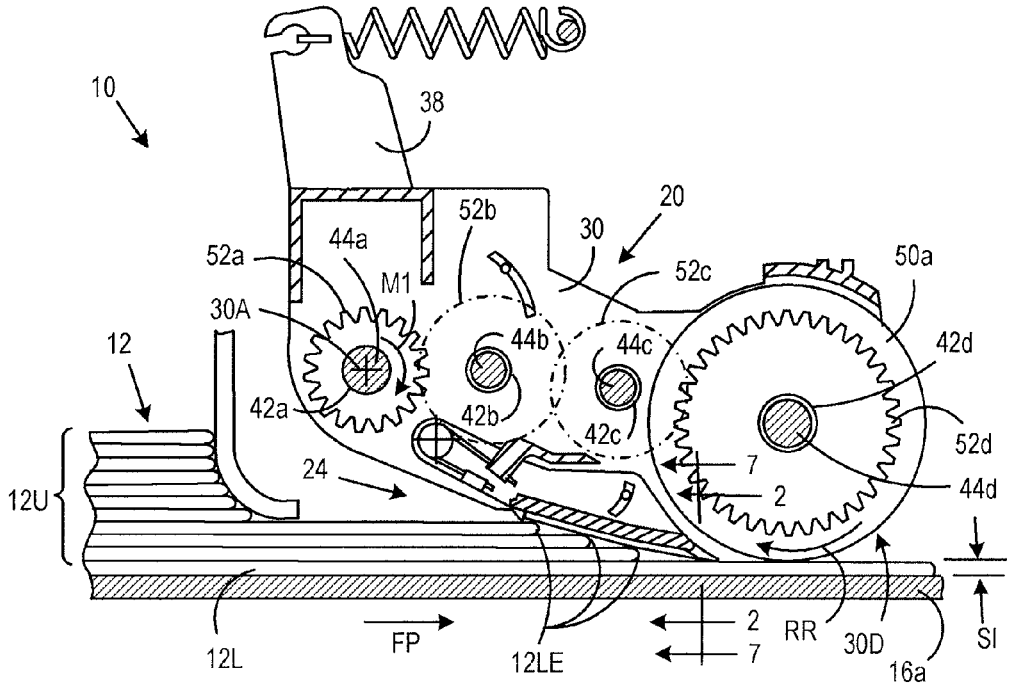
FIG. 1 is a side view of a singulating apparatus including an ingestion assembly according to the present invention and a plurality of horizontal conveyor belts, which, in combination, define an ingestion throat operative to shingle a stack of mailpieces and singulate individual mailpieces from the stack.

An ingestion assembly is provided for a singulating apparatus having a conveyor system for moving a stack of sheet material along a feed path. The ingestion assembly is spatially positioned above the conveyor belt and includes at least one singulating roller driven in a direction opposing the motion of the conveyor belt. The ingestion assembly comprises an assembly support rotationally mounting the singulating roller at a downstream end portion and pivotally mounting to the singulating apparatus at an upstream end portion. A movable guide mounts to the assembly support and is positionable relative thereto as a function of a force vector imposed on the guide by the sheet material. Additionally, the moveable guide includes a surface operative to guide the sheet material into a singulating interface which is formed between the singulating roller and the conveyor system. In operation, sheet material enters the throat of the ingestion assembly and contact is made with the moveable guide. When the force vector, imposed by the sheet material, is less than a threshold level, the guide assumes a first position operative to shingle sheet material in preparation for singulation by the singulating roller. When the force vector, is greater than the threshold level, the movable guide assumes a second position operative to pivot the assembly support and increase the singulation interface. Consequently, sheet material having a larger thickness dimension may pass for singulation from the mailpiece stack.

DETAILED DESCRIPTION

The present invention is described in the context of a singulating apparatus for mailing machines, though the invention is applicable to any singulation module/assembly for separating sheet material. For example, other sheet material handling apparatus which require separation of individual sheets from a stack of sheets include mailpiece sorting machines, copying and facsimile machines, etc. Furthermore, while the invention is described in the context of a singulation apparatus having a plurality of spaced conveyor belts for transporting a stack of sheet material, the apparatus may employ any number of belts, rollers or similar sheet transport devices. Additionally, while the singulating apparatus of the present invention includes singulating rollers which rotate in a direction opposing the movement of the underlying conveyor belts, it should be appreciated that the rollers need not rotate in an opposite direction, but merely move relative to the conveyor belts. For example, the roller may be stationary or rotating the in same direction but at a reduced velocity relative to the conveyor belts such that relative motion effects shingling and singulation of a stack of sheet material.

The invention is principally directed to the ingestion assembly of the singulating module/apparatus or the portion singulating apparatus which is spatially positioned above the conveyor belts. The ingestion assembly also establishes the upper bounds of the ingestion area and defines the upper portion of the V-shaped throat. Furthermore, the ingestion assembly, in combination with the lower conveyor belts, also creates a singulating interface for separating and passing an individual sheet, i.e., the lowermost sheet, from the stack.

This arrangement is more clearly understood by reference to FIG. 1, which illustrates a side view of an apparatus 10 for singulating a stack of sheet material 12, i.e., mailpiece envelopes, for performing subsequent processing operations such as the insertion of content material, sealing operations, weighing, and/or printing postage indicia. As mentioned in the background of the invention, the term "sheet material" means any substantially thin, flat, two-dimensional object or media which is typically handled along or on one of its face surfaces. Furthermore, the terms "sheet material", "mailpiece", "envelope", and "mailpiece envelope" are used interchangeably throughout the specification to mean the workpiece handled (e.g., shingling, separation and/or singulation). Additionally, various portions of the singulating apparatus 10 have been broken-away in FIG. 1 to reveal the principal inventive elements and features.

Figure 2:
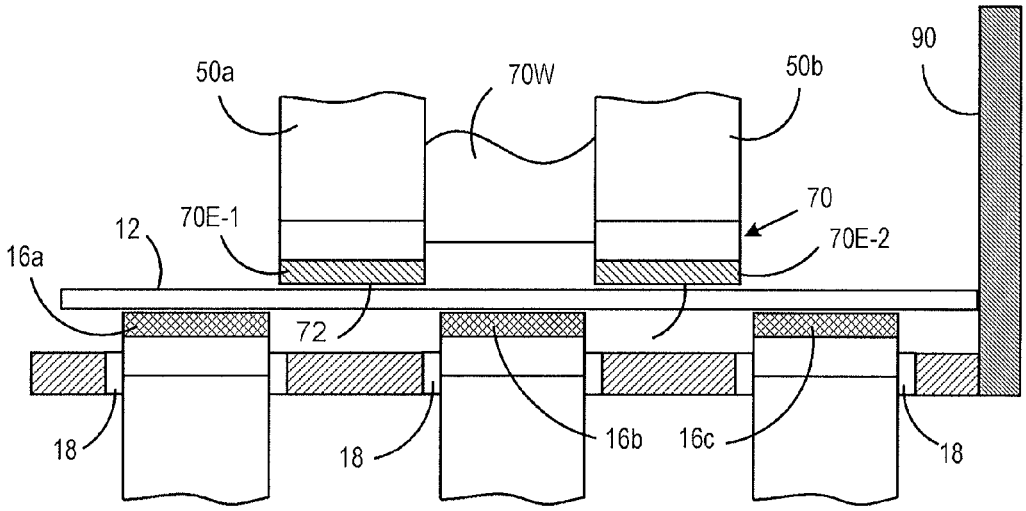
FIG. 2 is a cross-sectional view taken substantially along line 2-2 of FIG. 1 depicting an end view of the singulating apparatus including: (i) a plurality of conveyor belts, (ii) a pair of singulating rollers, and (iii) an end portion of a moveable singulating guide disposed under each of the singulating rollers for singulating a mailpiece between a singulation interface.

The singulating apparatus 10 includes a plurality of horizontal conveyor belts 16*a*, 16*b*, 16*c* (all conveyor belts are shown in FIG. 2) and an ingestion assembly 20, according to the present invention, spatially positioned over the conveyor belts 16*a*, 16*b*, 16*c*. In FIGS. 1 and 2, the conveyor belts 16*a*, 16*b*, 16*c* comprise three roller-driven belts 16*a*, 16*b*, 16*c* which are laterally-spaced to increase the area over which the belts 16*a*, 16*b*, 16*c* may act on/move the mailpiece stack 12S. In the described embodiment, the belts 16*a*, 16*b*, 16*c* project through longitudinal openings of a transport deck 18 (FIG. 2) and move the stack 12 along a feed path, denoted by an arrow FP in FIG. 1.

The mailpiece stack 12S is conveyed toward the ingestion assembly 20 and into an ingestion area or throat 24. There, the mailpieces 12 are shingled, i.e., the leading edges 12LE thereof, are separated/staggered and, finally, singulated such that the lowermost mailpiece 12L passes downstream of the ingestion assembly 20 and is separated from the stack 12S. Before discussing the operation of the singulation apparatus 10, it will be useful to describe some of the principal elements of the ingestion assembly 20 and the structural interaction between elements.

Figure 3:
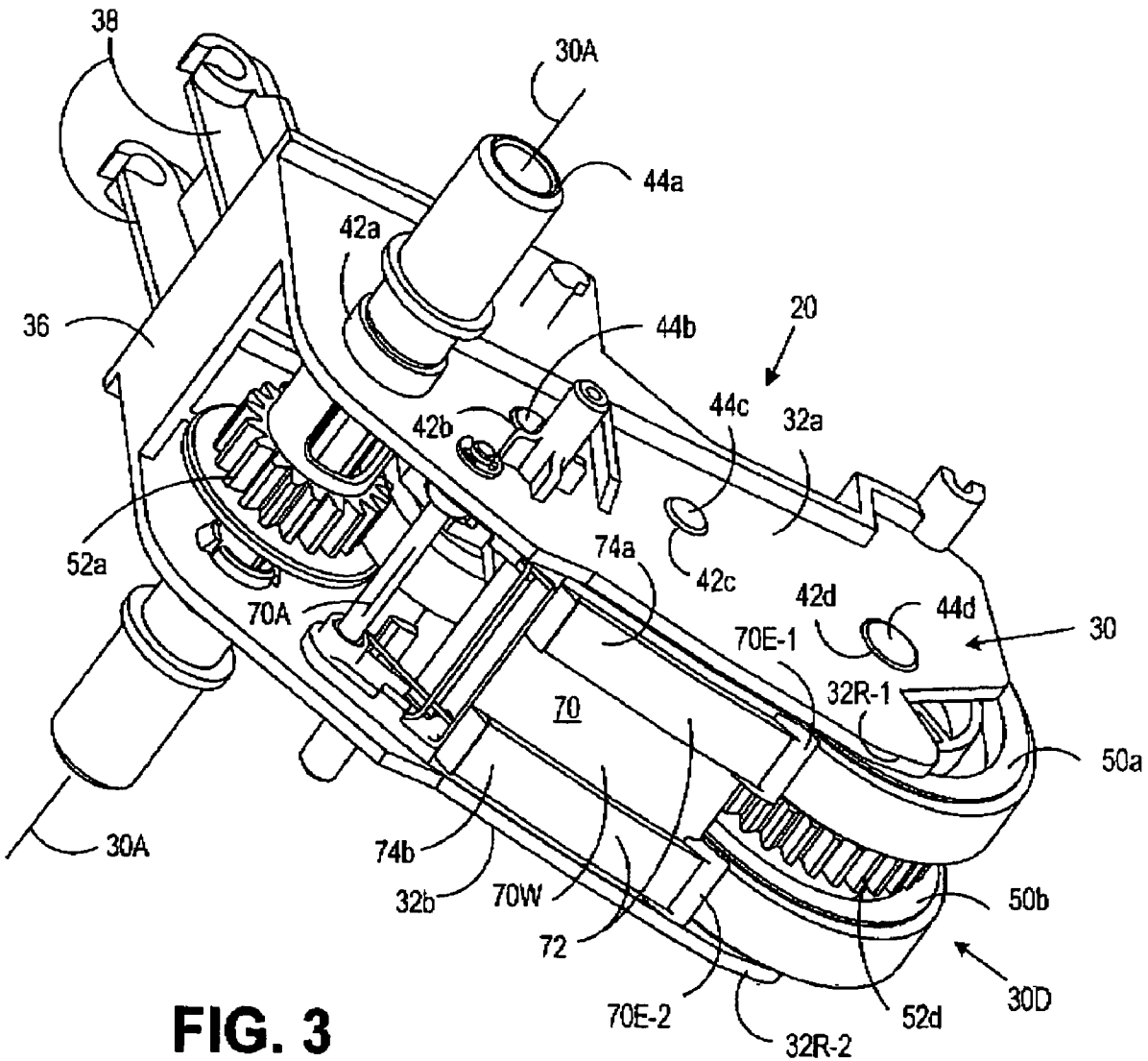
FIG. 3 is an underside perspective view of the ingestion assembly for illustrating an assembly support for mounting the singulating rollers and the moveable singulating guide.

In FIGS. 1 and 3, the ingestion assembly 20 includes an assembly support 30 pivotally mounting to the singulating apparatus about a pivot axis 30A. The assembly support 30 includes (i) a pair of vertical sidewall structures 32*a*, 32*b*, (ii) a cross-beam support 36 extending between and structurally connecting the sidewall structures 32*a*, 32*b*, (iii) vertical arms 38 for reacting a moment load M1 imposed about the pivot axis 30A and (iv) a plurality of aligned bearing support apertures 42*a*, 42*b*, 42*c*, 42*d* disposed in each of the sidewall structures 32*a*, 32*b* for accepting a plurality of mounting shafts/axles 44*a*, 44*b*, 44*c*, 44*d*.

A pair of singulating rollers 50*a*, 50*b* (best seen in FIG. 3) mount to a downstream end portion 30D the assembly support 30 and are driven by a series of spur gears 52*a*, 52*b*, 52*c*, 52*d* disposed between the sidewall structures 32*a*, 32*b*. The singulating rollers 50*a*, 50*b* are driven in a direction opposing the linear motion of the underlying conveyor belts 16*a*, 16*b*, 16*c*, i.e., in a clockwise direction as indicated by the arrow RR shown in FIG. 1. Furthermore, the singulating rollers 50*a*, 50*b* in combination with the conveyor belts 16*a*, 16*b*, 16*c* define a singulating interface SI for enabling the passage or separation of the lowermost mailpiece 12L from the mailpiece stack 12S. Generally, the singulation gag SG is predetermined or prescribed to accept and singulate sheet material having a minimum thickness dimension.

Figure 4:
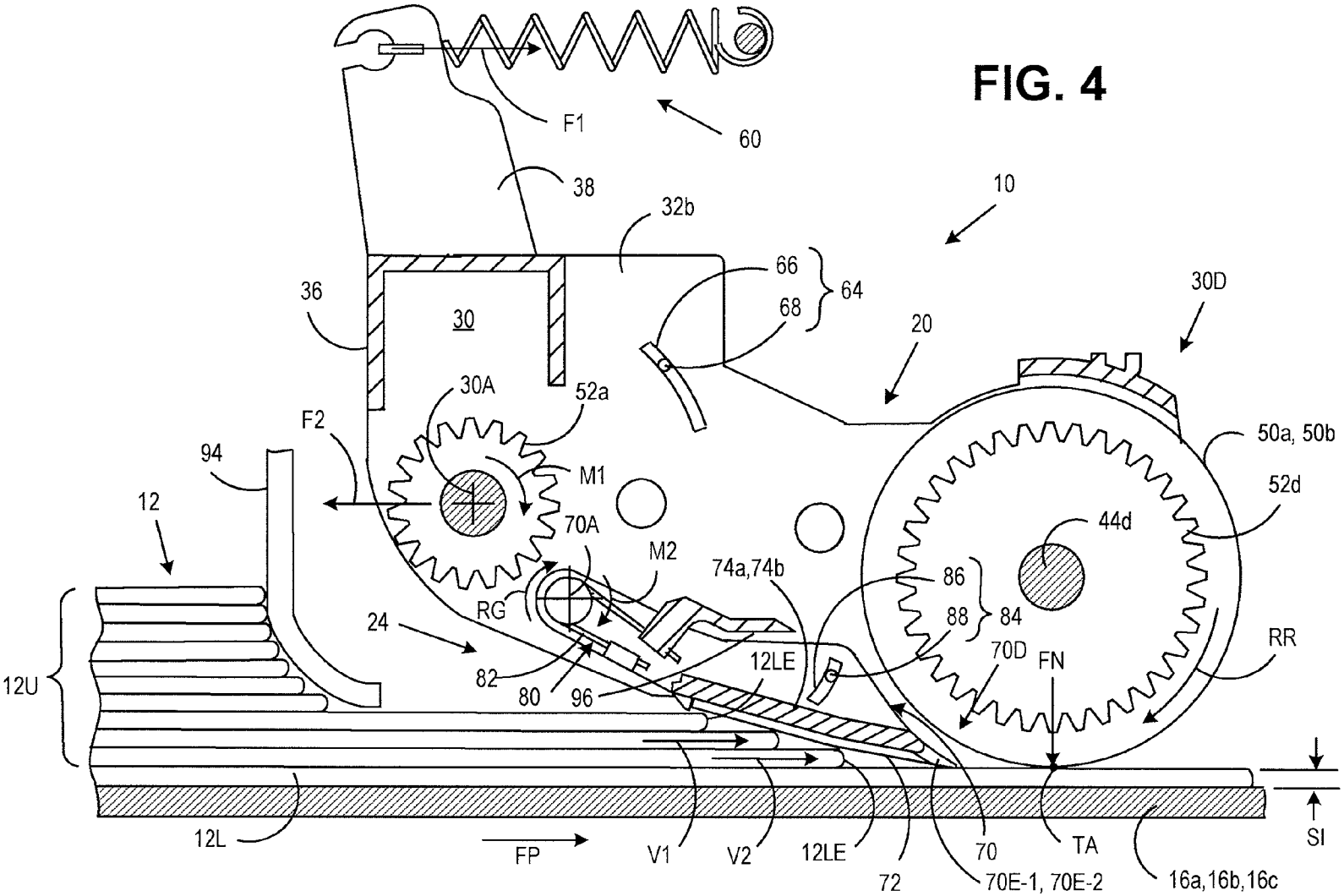
FIG. 4 is an enlarged view of the ingestion guide assembly shown in FIG. 1 wherein a stack of mailpieces having a nominal thickness dimension are shingled by the singulating guide as they enter the ingestion throat of the singulating apparatus.

In FIGS. 3 and 4, the singulating rollers 50*a*, 50*b* co-axially mount to and rotate with the output spur gear 52*d* about the mounting shaft 44*d*. The output spur gear 52*d* is driven by intermediate gears 52*b*, 52*c* which are, in turn, driven by the input spur gear 52*a*. The input spur gear 52*a* is co-axially aligned with the pivot axis 30A of the assembly support 30 thereby facilitating pivot motion of the assembly support 30 while providing access for driving the input spur gear 52*a*. Finally, the output spur gear 52*d* has the largest root diameter for effecting a speed reduction from the rotational speed of the input gear 52*a*.

A first spring biasing device 60 is coupled to the vertical arm 38 of the assembly support 30 and is operative to bias the downstream end portion 30D thereof toward the conveyor belts 16*a*, 16*b*, 16*c*. That is, the spring biasing device 60 produces a moment load M1 (due to the generation of a force couple F1, F2) about the axis 30A to pivot the assembly support 30 i.e., in a clockwise direction, and urge the singulating rollers 50*a*, 50*b* against an underlying mailpiece 12. As such, a normal force FN is applied to the interface between (i) the singulating rollers 50*a*, 50*b* and the upper face of the mailpiece 12L and (ii) the opposing lower face of the mailpiece 12L and the underlying conveyor belts 16*a*, 16*b*, 16*c*.

To maintain a predefined singulating interface SI between the singulating rollers 50*a*, 50*b* and the underlying conveyor belts 16*a*, 16*b*, 16*c*, the ingestion assembly 20 may include a motion limiter 64 to limit the pivot motion of the assembly support 30. More specifically, one or both of the sidewall structures 32*a*, 32*b* may include an oversized aperture or arcuate slot 66 for accepting a laterally protruding pin 68, i.e., normal to the surface of the respective one of the sidewall structures 32*a*, 32*b*. The pin 68, which is fixedly mounted to a stationary structure of the singulation assembly 10, traverses within the arcuate slot 66 to facilitate pivot motion and abuts each end of the slot 66 to limit pivot motion about the pivot axis 30A. The size and shape of the slot 66 will be determined by the location of the slot 66 relative to the pivot axis 30A and the angular motion accommodated by the motion limiter 64. Again, the singulating interface SI is generally sized to singulate the minimum thickness expected.

A movable singulating guide 70 is pivot mounted to the assembly support 30. Specifically, the singulating guide 70 is disposed between and pivotally mounts to each of the sidewall structures 32*a*, 32*b* about an axis of rotation 70A. The singulating guide 70, furthermore, includes a guide surface 72 which faces the ingested mailpieces 12 and defines the upper bounds of the ingestion area 24. The guide surface 72 includes a central web 70W (see FIG. 3) extending between and connecting a pair of tapered guide ends 70E-1, 70E-2 which extend lengthwise beyond the central web 70W and toward each of the singulating rollers 50*a*, 50*b*. The tapered guide ends 70E-1, 70E-2, furthermore, have a cross-sectional shape which complements the arcuate shape of the singulating rollers 50*a*, 50*b*.

Functionally, the tapered guide ends 70E-1, 70E-2 permit the leading edge of each mailpiece 12 to move under the singulating rollers 50*a*, 50*b* before making contact with the rollers 50*a*, 50*b*. Accordingly, the guide ends 70E-1, 70E-2 cause the leading edge of each mailpiece 12 to contact the singulating rollers 50*a*, 50*b* at a desirable angular position. Generally, a shallow contact angle is most desirable (i.e., contacting the singulating rollers 50*a*, 50*b* near the point of tangency TA with a horizontal line) to mitigate damage to the leading edge 12LE of the mailpieces 12. Preferably, the contact angle along the singulating roller should be less than about twenty degrees relative to the horizontal line which intersects or contains the point of tangency TA.

The guide surface 72 and singulating rollers 50*a*, 50*b*, furthermore, have a surface finish and normal force which produce a characteristic friction force. This friction force is higher than the friction forces developed between contiguous mailpieces 12. The friction coefficient produced by the guide surface 72 is high relative to the friction coefficient produced by the parent material employed in the construction of the singulating guide 70. In the described embodiment, the guide surface 72 includes a pair of compliant pads 74*a*, 74*b* which extend the length of the guide surface and correspond in location and width to each of the singulating rollers 50*a*, 50*b*. That is, each of the compliant pads 74*a*, 74*b* are aligned with, and have a width dimension substantially equal to, the width of the respective/corresponding singulating roller 50*a* or 50*b*. The friction coefficient $\mu_{fPAD}$ of each of the pads 74*a*, 74*b* may be within a range of between about 0.7 to about 1.0 whereas the friction coefficient $\mu_{fMP}$ between adjacent or contiguous mailpieces may be within a range of between about 0.1 to about 0.5. Furthermore, the friction coefficient $\mu_{fPM}$ of the parent material, e.g., a thermoplastic composite, may be within a range of between about 0.1 to about 0.3. Generally, however, the compliant pads 74*a*, 74*b* produce a friction force which is at least two times greater than the friction force which may be developed between the mailpiece 12 and the parent material employed in the construction of the singulation guide 70. The import of the compliant pads 74*a*, 74*b* and the friction properties associated therewith will be made clear when discussing the various operating modes of the inventive ingestion assembly 20.

Similar to the assembly support 30, the singulating guide 70 is pivot mounted such that its downstream end 70D is biased downwardly toward the underlying conveyor belts 16*a*, 16*b*, 16*c*. More specifically, a second spring biasing device 80 produces a moment load about the axis 70A tending to pivot the singulating guide 70 in a clockwise direction as indicated by the arrow RG shown in FIG. 4. In the described embodiment, a conventional torsion spring 82 mounts at one end to the assembly support 30, circumscribes the pivot axis 70A, and mounts at the other end to the singulating guide 70.

The moment load M2 produced by the second spring biasing device 80 is substantially lower or less than the moment load M1 produced by the first spring biasing device 60. In the context used herein "substantially lower" means that the moment load M2 is about one-half to about one-tenth (i.e., 0.5 to about 0.1) of the moment load M1. Stated in another way, the spring rate stiffness $\kappa_1$ of the first spring biasing device 60 is substantially higher than the spring rate stiffness $\kappa_2$ of the second spring biasing device 80. When comparing the spring rate stiffness values of the spring biasing devices 60, 80, the relative magnitudes associated with the moment loads M1/M2 may be applied with the same validity. That is, the spring rate stiffness $\kappa_1$ of the first spring biasing device 60 is about two (2) to ten (10) times greater than the spring rate stiffness $\kappa_2$ of the second spring biasing device 80.

Consequently, these relationships/values can be used to evaluate the force vectors required to pivot/rotate (i.e., in a counterclockwise direction) (i) singulation guide 70, (ii) the assembly support 30, and/or (iii) the combination of the singulation guide 70 and the assembly support 30. While force vectors V1, V2 (in the direction of the feed path) may not be imposed at precisely the same locations due to the geometry of the ingestion assembly 20, a linear force vector V1 required to rotate the singulation guide 70 is substantially less than the linear force vector V2 required to rotate the assembly support 30 or the combined assembly support and singulation guide 70. The import of this relationship will be appreciated when examining the operation of the ingestion assembly as mailpieces enter the ingestion area or throat 24.

To prevent the singulating guide 70 from contacting/wearing the conveyor belts 16*a*, 16*b*, 16*c*, a second motion limiter 84 may be employed to optimize the angular position of the guide surface 72. Similar to the first motion limiter 64, the second limiter 84 may employ an arcuate slot or channel 86 formed in one or both of the sidewall structures 32*a*, 32*b*. The arcuate slot or channel 86 receives a stop pin 88 which protrudes laterally, i.e., inwardly, from the singulating guide 70 and limits the downward pivot motion of the singulating guide 70 relative to the assembly support 30.

While the second motion limiter 86 may include an upper stop limit surface, i.e., incorporated at the lower end of the arcuate slot 86, the assembly support 30 includes a more robust abutment or stop surface 96 to limit the upward motion of the singulating guide 70. Hence, in an operating mode where the singulating guide 70 engages the stop surface 96, the assembly support 30 and singulating guide 70 pivot in unison (i.e., in a counterclockwise direction) and may be viewed as an integrated unit. While the stop surface 96 provides a positive means for transmitting loads acting on the singulation guide 70, e.g., a force vector imposed by a collection of mailpieces or single thick mailpiece, into the assembly support 30, the stop surface 96 is also operative to prevent the tapered guides 70E-1, 70E-2 from contacting the singulating rollers 50*a*, 50*b*.

The methodology for establishing the location of the stop surface 96 can be as simple as identifying the position of the singulation guide 70 immediately prior to contacting the singulating rollers 50*a*, 50*b*, or involve greater complexity such as a tool to vary the friction forces acting on and between the ingestion assembly, the conveyor belts and/or the underlying mailpieces 12.

Figure 5:
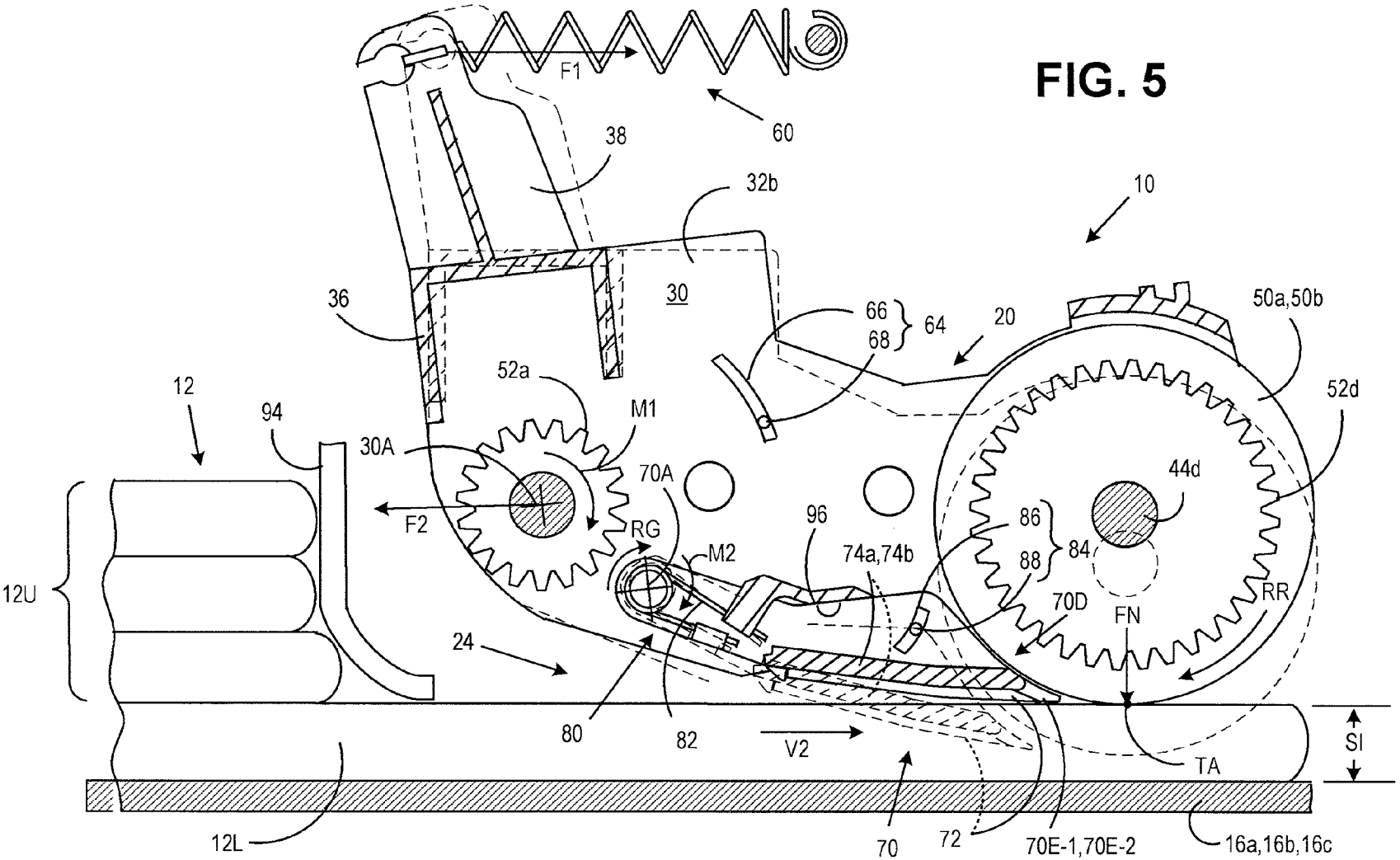
FIG. 5 is an enlarged view of the ingestion guide assembly shown in FIG. 1 wherein a stack of mailpieces having a maximum thickness dimension urge the singulating guide and ingestion assembly to pivot upwardly to increase the opening of the singulating interface.

FIGS. 4 and 5 depict two operating modes for shingling and singulating mailpieces. In FIG. 4, a stack of thin mailpieces, i.e., between about 0.030 inches to 0.375 inches in thickness, are shingled and singulated. In FIG. 5 a stack of thick mailpieces, i.e., up to about 0.75 inches in thickness, are shingled and singulated. In FIG. 4, a stack of mailpieces 12 having a nominal thickness dimension are placed upon the conveyor belts 16*a*, 16*b*, 16*c* and fed into the throat 24 between the ingestion assembly 20 and the belts 16*a*, 16*b*, 16*c*. Generally, an edge of each mailpiece 12, best seen in FIG. 2, abuts and is guided by a registration wall 90. As the stack approaches the ingestion assembly 20, a portion of the stack, i.e., the upper mailpieces 12U, are held back by a fixed retention guide 94 which allows the lowermost mailpieces 12L to pass into the ingestion area 24 of the singulation apparatus 10.

The lowermost mailpieces 12L pass under the singulation guide 70 while the remaining mailpieces 12U, stacked thereupon, contact the singulation guide 70. Should the friction forces between mailpieces be sufficiently high, a stack of thin mailpieces 12 imposes a force vector sufficient to counteract the moment load M1 and pivot the singulation guide 70 upward, i.e., in a counterclockwise direction. At the same time, the assembly support 30 remains in its original position, i.e., motionless, due to the high counteracting moment M2 imposed by the first spring biasing device. That is, while the force vector imposed by the mailpieces 12 is sufficiently high to pivot the singulation guide 70, it remains below a threshold level, i.e., a level insufficient to pivot the assembly support 30. Consequently, the position of the singulating rollers 50*a*, 50*b* remains fixed and the size of the singulating interface SI remains constant.

Accordingly, mailpieces 12 passing under the singulation guide 70 are retarded by the singulation rollers 50*a*, 50*b* while those remaining in contact with the singulation guide 70 continue to be separated. That is, as the singulation guide 70 pivots upward, the ingestion angle becomes more acute or shallow such that as the mailpieces 12 continue toward the singulation roller 50*a*, 50*b*, they separate/shingle in preparation for singulation. Additionally, the high friction coefficient produced by the compliant pads 74*a*, 74*b* augments shingling by preventing the upper mailpieces 12U from prematurely sliding past the singulation guide 70. That is, the high friction surface prevents the mailpieces 12U from sliding under the singulation guide 70 before being properly separated/shingled.

In FIG. 5, a stack of mailpieces 12 having a larger thickness dimension, e.g., a maximum thickness, is placed upon the conveyor belts 16*a*, 16*b*, 16*c* and fed into the throat 24 between the ingestion assembly 20 and the belts 16*a*, 16*b*, 16*c*. Inasmuch as the mailpieces 12 are thick, (i.e., approximately three times the thickness of the mailpieces 12 examined in the previous FIG. 4) only a single mailpiece 12 enters the ingestion area 24 of the singulation apparatus 10. It will be recalled that in the previous operating mode, the assembly support 20 remained fixed/motionless to maintain the position of the singulating rollers 50*a*, 50*b* and the size of the singulating interface SI. This position is shown in dashed lines in FIG. 5. In the present operating mode, however, the spatial relationship between the ingestion assembly 20 and conveyor belts 16*a*, 16*b*, 16*c*, changes to accommodate the increased mailpiece thickness.

More specifically, upon entering the ingestion area 24, a lower mailpiece 12L contacts the singulation guide 70 prior to contact with the singulating rollers 50*a*, 50*b*. Inasmuch as the force vector required to rotate the singulation guide 70, (i.e., to overcome the moment M1 imposed by the second spring biasing device) is low, the mailpiece 12L lifts the guide 70 into abutting engagement with an upper stop surface 96 of the assembly support 30. As the conveyor belts 16*a*, 16*b*, 16*c* continue to drive the motion of the lower mailpiece 12L forward, the force vector V2 becomes sufficiently large to overcome the moment M1 imposed by the first spring biasing device 60. That is, the force vector V2 is equal to or greater than the threshold level, i.e., a level sufficiently high to pivot the assembly support 30. As the assembly support 30 rotates, the singulation rollers 50*a*, 50*b* are raised relative to the conveyor belts 16*a*, 16*b*, 16*c*. In FIG. 5, the raised position is shown in solid lines. Consequently, the singulating interface SI increases to allow the passage of the thick mailpiece 12L.

Figure 6:
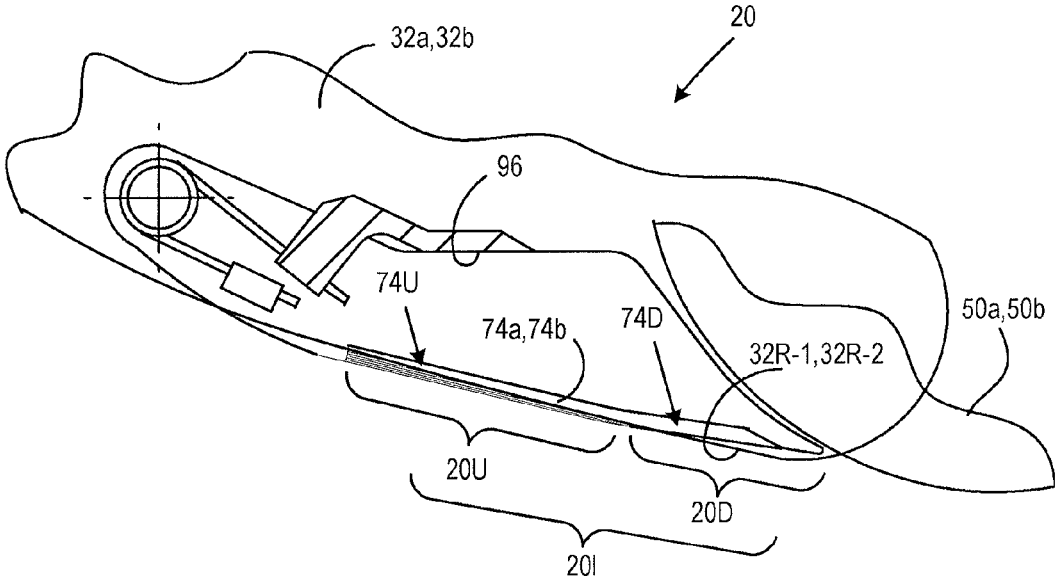
FIG. 6 is an enlarged broken away side view of the ingestion assembly wherein the singulating guide includes a compliant pad and wherein the compliant pad in combination with the assembly support defines a surface finish having a variable friction coefficient to augment the singulation of thick and thin mailpieces.

In another embodiment of the invention, shown in FIG. 6, the ingestion assembly 20 defines a variable friction interface immediately upstream of the singulating rollers 50*a*, 50*b*. From the foregoing discussion, it will be appreciated that the friction developed between the mailpieces and/or the mailpieces and the various mating surfaces, e.g., the conveyor belts 16*a*, 16*b*, 16*c*, singulating rollers 50*a*, 50*b* and/or guide surface 72, play a vital role in the efficiency of the singulating apparatus 10. To obtain an even greater level of understanding, the inventors performed an extensive evaluation of the factors influencing the successful singulation of both thin and thick mailpieces. Based upon that evaluation, it is understood that by varying the friction coefficient along the length of the ingestion assembly 20, an even greater percentage of mailpieces 12 may be successfully singulated, i.e., without a misfeed, double-feed or damage to the mailpiece leading edge.

In accordance with this embodiment of the invention, the ingestion assembly 20 defines a friction interface having a friction coefficient which decreases from an upstream end 20U to a downstream end 20D. The friction coefficient may be decreased in a variety of ways such as increasing the hardness of the compliant pads 74*a*, 74*b* from the upstream to downstream ends thereof. Alternatively, the ingestion assembly 20 may be configured to include multiple guide surfaces for shingling and guiding the mailpieces 12. For example, the assembly support 30 may be adapted to include guide rails 32R-1, 32R-2 (see FIG. 3), disposed to each side of the singulation rollers 50*a*, 50*b*. In the described embodiment, the guide rails 32R-1, 32R-2 may be formed in combination with the sidewall structures 32*a*, 32*b* of the assembly support 30.

Furthermore, the abutment surface 96 of the assembly support 30 may be located or positioned between the sidewall structures 32*a*, 32*b* such that the compliant pads 74*a*, 74*b* of the singulation guide 70 gradually recede relative to and between the guide rails 32R-1, 32R-2. That is, an upstream portion 74U of the pads 74*a*, 74*b* may be exposed while a downstream portion 74D may be recessed relative to the guide rails 32R-1, 32R-2. Moreover, the guide surfaces of the ingestion assembly 20, i.e., the surfaces which the mailpieces 12 slide upon or contact during singulation, transitions from the compliant pads 74*a*, 74*b* to the guide rails 32R-1, 32R-2. Inasmuch as the compliant pads 74*a*, 74*b* may be composed of a material having a high friction coefficient, e.g., between 0.8 to 1.0 and the guide rails 32R-1, 32R-2 may be fabricated from a material having a comparatively low friction coefficient, e.g., between 0.2 to 0.4, the friction forces tending to shingle and separate the mailpieces 12 vary or decrease from the upstream portion 20U of the ingestion assembly 20, i.e., corresponding to the exposed portion of the compliant pads 74*a*, 74*b*, to the downstream portion 20D i.e., corresponding to the surface of the guide rails 32R-1, 32R-2. Furthermore, when singulating a combination of thick and thin mailpieces, thick mailpieces may slide freely under the low friction coefficient produced by the guide rails 32R-1, 32R-2, while thin mailpieces may be separated and are shingled by the high friction coefficient produced by the compliant pads 74*a*, 74*b*.

Figure 7:
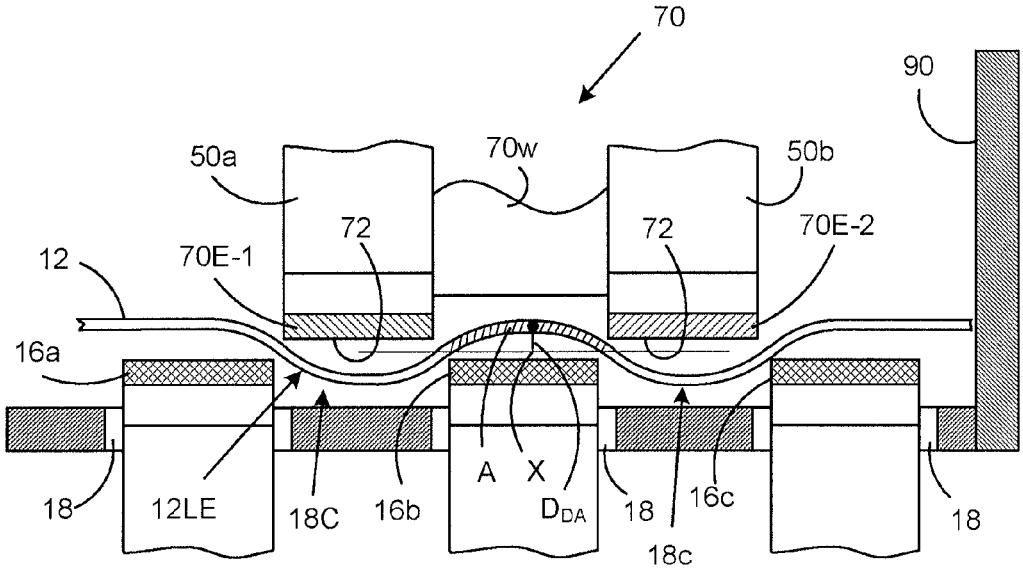
FIG. 7 is a cross-sectional view taken substantially along line 7-7 of FIG. 1 depicting and end view of the singulating apparatus wherein the interaction of the singulation guide and conveyor belts causes the leading edge of the sheet material to assume a wave-shaped end profile for mitigating leading edge damage.

In accordance with yet another embodiment of the invention, the tapered guide ends 70E-1, 70E-2, recessed web 70W, and spaced conveyor belts 16*a*, 16*b*, 16*c* are adapted to mitigate damage to the leading edge of singulated mailpieces 12, i.e., prevent the singulating rollers 50*a*, 50*b* from peeling the leading edge 12LE upwardly during singulation. More specifically, and referring to FIG. 7, as each mailpiece 12 passes under the singulating guide 70, the tapered guide ends 70E-1, 70E-2 urge the mailpiece leading edge into channels 18C between the spaced conveyor belts 16*a*, 16*b*, 16*c*. As such, the opposing/staggered forces cause the leading edge 12LE to assume a curved/wave-shaped end profile. Inasmuch as the mass moment of inertia (MMI) $I_X$ about an axis X, is a function of the area A multiplied by the distance from the area centroid $D_{DA}$, the wave-shaped end configuration changes the distribution of mass about the axis X (i.e., increases the distance from the area centroid $D_{DA}$,) to increase the MMI.

By increasing the MMI about the bending axis X, the bending stiffness (i.e., a function of the MMI multiplied by the material modulus) increases to mitigate the shear and bending forces tending to deform or peel the leading edge 12LE upwardly.

In summary, the singulation apparatus 10 and ingestion assembly 20 therefor, reliably shingles and singulates thin and thick sheet material. Thin sheets/mailpieces, which may have a tendency to double-feed, are separated and shingled upstream of the opposing singulating roller 50*a*, 50*b* by the geometry and inclination i.e., the ingestion angle, produced by the movable singulation guide 70. Furthermore, the high friction interface produced by the compliant pads 74*a*, 74*b* augments the degree of separation between sheets/mailpieces. Thick sheets/mailpieces, which may have a tendency to mis-feed (i.e., become jammed or do not pass the singulating interface, are singulated by pivotally mounting the assembly support. That is, the singulating interface SI. increases in size by causing thick sheets/mailpieces to rotate and lift the singulation rollers 50*a*, 50*b*. Furthermore, by varying the location of the abutment surface 76 and the friction coefficient along the underside guide surfaces, i.e., the compliant pads 74*a*, 74*b* and guide rails 32R-1, 32R-2, thick sheets/mailpieces may slide freely under the low friction coefficient produced by the guide rails 32R-1, 32R-2, while thin sheets/mailpieces are shingled by the high friction coefficient produced by the compliant pads 74*a*, 74*b*. Finally, the singulation guide 70, and, more particularly the interaction between the tapered guide ends 70E-1, 70E-2 thereof and the underlying conveyor belts 16*a*, 16*b*, 16*c*, can be adapted to effect a curved or wave-shaped leading edge profile. As such, the leading edge is structurally stiffened to mitigate damage thereto upon contacting the singulation rollers 50*a*, 50*b*.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. An ingestion assembly for a singulating apparatus including a conveyor system for moving a stack of sheet material along a feed path, the ingestion assembly being spatially positioned above the conveyor system and including at least one singulating roller driven in a direction opposing the motion of the conveyor system, the ingestion assembly comprising:

an assembly support rotationally mounting the singulating roller at a downstream end and being pivotally mounted to the singulating apparatus at an upstream end;

a movable guide having a surface operative to guide the sheet material into a singulating interface between the singulating roller and the conveyor belt, the moveable guide mounted to the assembly support and positionable relative thereto as a function of the magnitude of a force imposed on the guide surface by the sheet material;

wherein the movable guide assumes a first position operative to shingle sheet material upstream of the singulating roller when the sheet material imposes a force which is less than a threshold level;

wherein the moveable guide assumes a second position operative to pivot the assembly support and enlarge the singulating interface when the sheet material imposes a force which is equal to or greater than the threshold level; and wherein the conveyor system includes a plurality of laterally spaced belts and wherein the moveable guide includes a pair of tapered guide ends and a central web therebetween, the central web being recessed relative to the guide ends such that, when the moveable guide cooperates with the conveyor belts, the sheet material assumes a wave-shaped end profile.

2. The ingestion assembly according to claim 1 wherein a friction force is developed between contiguous sheets of material, and wherein the guide surface has a surface finish which produces a friction force which is greater than the friction force developed between contiguous sheets of material.

3. The ingestion assembly according to claim 2 wherein the guide surface includes at least one compliant pad disposed along the length of the guide surface and has a width dimension corresponding to the width dimension of the singulating roller.

4. The ingestion assembly according to claim 3 wherein the friction force developed between the compliant pad and the sheet material is at least two times greater than the friction force developed between the sheet material and a material employed in the construction of the singulation guide.

5. The ingestion assembly according to claim 1 wherein the conveyor belts define longitudinal channels between pairs of belts, and wherein the longitudinal channels accept the tapered guide ends to facilitate formation of the wave-shaped end profile.

6. The ingestion assembly according to claim 1 wherein the assembly support, in combination with the singulating guide, define a variable friction interface upstream of the singulating rollers.

7. The ingestion assembly according to claim 6 wherein the friction interface has a friction coefficient which decreases from an upstream end to a downstream end.

8. The ingestion assembly according to claim 7 wherein the assembly support is adapted to include guide rails disposed to each side of the singulation rollers, the guide rails having a characteristic first friction coefficient, wherein the guide surface includes at least one compliant pad disposed along the length of the guide surface, the compliant pad having a characteristic second friction coefficient, wherein the movable singulating guide is mounted to the assembly support such that the compliant pad gradually recedes relative to and between the guide rails from an upstream to a downstream end portion, the upstream end portion of the compliant pad defining the upstream end of the frictional interface and the guide rails defining the downstream end of the frictional interface, and wherein the second friction coefficient is higher than the first friction coefficient to produce the variable friction interface.

9. A singulating apparatus including a conveyor system for moving a stack of mailpieces along a feed path, the singulating apparatus comprising:

an ingestion assembly being spatially positioned above the conveyor system and including at least one singulating roller driven in a direction opposing the motion of the conveyor system, the ingestion assembly including an assembly support pivotally mounting to a stationary structure of the singulating apparatus and a movable guide pivotally mounting to the assembly support, the assembly support rotationally mounting the singulating roller at a downstream end and being pivotally mounted to the singulating apparatus at an upstream end;

the movable guide having a surface operative to guide each of the mailpieces into a singulating interface between the singulating roller and the conveyor belt, and positionable relative to the assembly support as a function of the magnitude of a force imposed on the guide surface by at least one of the mailpieces;

the movable guide assuming a first position to shingle mailpieces upstream of the singulating roller when the mailpieces impose a force which is less than a threshold level;

the movable guide assuming a second position to pivot the assembly support and enlarge the singulating interface when the at least one of the mailpieces imposes a force which is equal to or greater than the threshold level; and wherein the conveyor system includes a plurality of laterally spaced belts and wherein the moveable guide includes a pair of tapered guide ends and a central web therebetween, the central web being recessed relative to the guide ends such that, when the moveable guide cooperates with the conveyor belts, the mailpieces assume a wave-shaped end profile.

10. The singulating apparatus according to claim 9 wherein a friction force is developed between contiguous mailpieces, and wherein the guide surface has a surface finish which produces a friction force which is greater than the friction force developed between contiguous mailpieces.

11. The singulating apparatus according to claim 10 wherein the guide surface includes at least one compliant pad disposed along the length of the guide surface and has a width dimension corresponding to the width dimension of the singulating roller.

12. The singulating apparatus according to claim 11 wherein the friction force developed between the compliant pad and the mailpiece is at least two times greater than the friction force developed between the mailpiece and a material employed in the construction of the singulation guide.

13. The singulating apparatus according to claim 9 wherein the conveyor belts define longitudinal channels between pairs of belts, and wherein the longitudinal channels accept the tapered guide ends to facilitate formation of the wave-shaped end profile.

14. The singulating apparatus according to claim 9 wherein the assembly support, in combination with the singulating guide, define a variable friction interface upstream of the singulating rollers.

15. The singulating apparatus according to claim 14 wherein the friction interface has a friction coefficient which decreases from an upstream end to a downstream end.

16. The singulating apparatus according to claim 15 wherein the assembly support is adapted to include guide rails disposed to each side of the singulation rollers, the guide rails having a characteristic first friction coefficient, wherein the guide surface includes at least one compliant pad disposed along the length of the guide surface, the compliant pad having a characteristic second friction coefficient, wherein the movable singulating guide is mounted to the assembly support such that the compliant pad gradually recedes relative to and between the guide rails from an upstream to a downstream end portion, the upstream end portion of the compliant pad defining the upstream end of the frictional interface and the guide rails defining the downstream end of the frictional interface, and wherein the second friction coefficient is higher than the first friction coefficient to produce the variable friction interface.

17. The ingestion assembly according to claim 1 wherein the singulating roller defines a point of tangency along a horizontal line, wherein the singulating guide defines at least one tapered end and wherein the tapered end is disposed proximal to the point of tangency of the singulating roller.

* * * * *